US006128984A

United States Patent [19]

Haupt

[11] Patent Number: 6,128,984

[45] **Date of Patent: *Oct. 10, 2000**

[54] MICRO-TORQUE LIMITING, SHOCK LIMITING TOOL AND SUBASSEMBLY

[76] Inventor: Chett D. Haupt, 741 Capricorn Cir., Fairfield, Calif. 94533

[ * ] Notice: This patent is subject to a terminal disclaimer.

[21] Appl. No.: 08/909,460

[22] Filed: Aug. 11, 1997

Related U.S. Application Data

[63] Continuation-in-part of application No. 08/533,280, Sep. 25, 1995, Pat. No. 5,655,421.

[51] Int. Cl.[7] ..... B25B 23/157

[52] U.S. Cl. ..... 81/473; 81/476; 192/66.3

[58] Field of Search ..... 81/473, 476, 478, 81/480, 467; 192/48.1, 66.1, 66.3, 70.11, 54.1

[56] References Cited

U.S. PATENT DOCUMENTS

| | | | |
|---|---|---|---|
| 1,697,595 | 1/1929 | Henderson | 192/66.3 |
| 1,876,990 | 9/1932 | Lormor | 81/476 |
| 2,398,330 | 4/1946 | Rueb | 81/476 |

*Primary Examiner*—David A. Scherbel
*Assistant Examiner*—Joni B. Danganan
*Attorney, Agent, or Firm*—Harold D. Messner

[57] ABSTRACT

A micro-torque limiting production tool and subassembly comprises a hollow cylindrically shaped housing in which a combination bit retainer clutch mechanism is supported. The combination bit retainer-clutch mechanism includes a pair of cylindrical drive and driven clutch disks of a plastic composite composed of teflon fluorocarbon and acetal resin, each having a bulbous region and a region supported front to back relative to each other to define a primary braking surface of area $\pi(D5/2)^2$ where D5 is the diameter of the bulbous region.

22 Claims, 15 Drawing Sheets

MICRO-TORQUE LIMITING, SHOCK LIMITING TOOL AND SUBASSEMBLY

This application is a Continuation-In-Part of patent application Ser. No. 08/533,280 filed on Sep. 25, 1995 which is now U.S. Pat. No. 5,655,421.

SCOPE OF THE INVENTION

The invention relates to torque limiting production tools and more specifically, but not by way of limitation, to a torque limiting production tool having an improved clutch mechanism that provides a smooth linearly loading function to a fastener during torquing thereof in a manner whereby shock wave generation is substantially reduced after a preset micro-torque value has been attained.

BACKGROUND OF THE INVENTION

Generally, in the majority of assembly applications (especially those related to the manufacture of disc driver assemblies for computers), the reliability of the joint is dependent upon how accurately and smoothly, the particular fastener or series of fasteners, can be made to clamp the assembly elements together. The clamping force is regulated by the amount of torque applied to the fasteners by production personnel (called torque control).

Engineers establish the theoretical torque value for a particular fastener using formulas that relate tensile stress of the fastener to equivalent stress of the fastener thread that takes into account the material used, thread pitch and minor diameters.

Then, the production personnel take the engineered torque value and after presetting their production tools to provide such torques during the particular mechanical jointing operations, manufacture the assemblies in a rapid manner in which the assembly elements pass from station to station using different preset production tools. Most production lines use production tools in which the torque value for a particular application has been preset for use at the particular station.

In disc drive assemblies, designers require greater storage capacity within a given physical space. Result: the longitudinal spacing between the magnetic discs along the central shaft, becomes less and less. Hence, as torque tolerances for assembly of the disc drives increase, say to tolerances of −+1.5 percent accuracy, conventional mechanical preset production tools have been found to be lacking in certain regards.

For example, where such tools rely upon ratchet type or other means of stepped loading of the fastener, they have been found to create shock waves at the fastener. Such waves are believed to originate at the fastener and are transmitted to the elements to be joined as stepped loading occurs. Where the elements to be assembled are stacks of magnetic discs of a disc drive assembly of a computer, such waves can cause the discs to change position, touch and otherwise inappropriately affect their operations.

One such step loading mechanical tool is shown in U.S. Pat. No. 4,063,474 wherein the described tool loading of the fastener uses a first annular clutch plate that is spring biased (i) longitudinally into contact with a second clutch plate integrally formed within a coextensive cylindrical handle (through a series of longitudinally restrained balls sitting in sets of pair of longitudinally offset pockets in the clutch plates), and (ii) radially through a second series of balls locked in a series of radial slots in the bit cylinder. The handle, clutch plates (and the bit cylinder) rotate together with the rotation of the handle until the torque at the fastener (through the bit cylinder) is greater than friction response (as provided by the spring) between the second series of balls and the outer surface of the bit cylinder. Then, the bit cylinder remains stationary, with both (or one) of the clutch plates and handle then rotating relative to the axis of symmetry of the bit cylinder. While such tools may be initially accurate, that fact that the clutch plates contact at separate lands associated with the restrained balls about the circumferential extending faces, has been found to contribute to the rise in inaccuracy of the tools with time. It is believed that each radially separated ball and associated pair of pockets as well as the longitudinal end loading of the series of balls against the bit cylinder, non-uniformly contributes to the total force preset into the tool. Moreover, the machining requirements to create the balls and restraining slots and pockets in the bit cylinder and clutch plates, respectively, are usually beyond the capability of production personnel to repair. As a result, repair cannot occur at the work site.

I am also aware of a digitally programmable mechanical electrical production tool in which electrical current is used to accurately drive a servo motor whereby the load can be linearly varied with time, which results in the achievement of accurate torque settings on a linear loading basis. However, due to the high initial cost, experience shows there is still a need for a completely mechanical torque limiting production tool, that is low cost, and that uses an easily serviceable clutch mechanism that (especially for use in micro-torque applications) limits shock wave generation and has high repeatability over many cycles of operations.

DEFINITION

DISC DRIVE ASSEMBLY includes a motor drive, a disk storage system and a head assembly in which a series of magnetic disks are stacked on a central shaft within a central housing rotated by a motor attached to a threaded end of the central shaft. The head assembly consists of READ-WRITE elements cantilevered from disc edges and attached to the housing (or subhousing) by fasteners. The central housing includes a cover attached by cover screws.

SHOCK WAVE GENERATION of an assembly during attachment of fasteners such as nuts and screws results from a longitudinal stepping of load by the nut driver against the fastener head causing a shock wave to translate through the fastener and thence to the assembly.

TENSIONING of a fastener relates to the force converted by a thread angle against a transverse support.

OPTIMUM TENSIONING of a fastener relates to a optimum torque/tension value applied to the fastener for each fastening application.

TORQUE relates to amount of force multiplied by the length of application described inch-pounds or inch-ounces.

ACCURACY means deviation within acceptable limits of a specified standard. FULL-SCALE ACCURACY relates to multiplying the stated full scale value by the full-scale deviation. READING/SETTING ACCURACY relates multiplying any value by the stated deviation.

PRESET VALUE relates the set tool value and lock same to prevent alteration of setting.

PRODUCTION TOOL is a tool that is preset to a torque limiting value for production line use.

REPEATABILITY is the extent to which repeated cycles of a tool produce identical values.

TENSION is the straight line force producing stretching of a bolt or screw fastener during torquing thereof.

MICRO-TORQUE value are in a range between about 8 inch-ounces to 8 inch-pounds for the production tool of the invention.

SUMMARY OF THE INVENTION

The present invention relates to micro-torque limiting production tool and subassembly. In one aspect, the tool includes a hollow cylindrically shaped handle having a side wall, an open end, a more closed end defined by a shoulder and a central cavity in which a combination bit retainer-clutch mechanism is supported. The combination bit retainer-clutch mechanism includes a pair of cylindrical clutch plates of a plastic composite such as a blend of teflon fluorocarbon and acetal resin identified with and by Federal Regulation and/or Specifications LP 392 A-type 2, ASP D-2133-8 and ASP D-4181-88, having bulbous regions of a common diameter D1 in axially broad contact with each other within the central cavity of the handle to define a primary braking surface therebetween of area $$\pi\left(\frac{D1}{2}\right)^2.$$

The reduced regions of diameter D2 of the clutch plates face in opposite directions each extending longitudinally of the handle from a shoulder region to a remote end segment. The remote end segment of one of the reduced regions, extends from the shoulder region through a secondary braking plate of annular cross section also of a plastic composite as identified above, to define a secondary braking surface equal to $$\pi\left[\left(\frac{D1-D2}{2}\right)\right]^2$$

(where D1 and D2 are the exterior and interior diameters of the secondary braking plate) and thence through an opening in the closed end of the handle. Such remote end segment is also placed in operable contact with a bit for micro-torquing purposes of a fastener. However, the remote end segment of the other of the reduced regions, extends oppositely from the bit, from the shoulder region through an annularly shaped retaining member within the more central region of the handle and thence connects to a compression spring longitudinally spanning a longitudinal space between a transverse pin extending through the remote end segment of the other of the reduced regions and a cap member also rotatably attached to the handle. Rotation of the cap member provides for both micro- changes in the friction force at the primary and secondary braking surfaces to provide for highly accurate preset micro-torquing values for the tool of the invention whereby a smooth linearly loading function is provided to any fastener in operative contact with the bit and shock wave generation thereat is substantially reduced.

In another aspect, the invention includes a modified torque limiting subassembly in which the combination bit retainer-clutch mechanism of the invention, is supported. The combination bit retainer-clutch mechanism includes a pair of cylindrical clutch disks of a plastic composite such as a blend of teflon fluorocarbon and acetal resin identified with and by Federal Regulations and/or Specifications LP 392 A-type 2, ASP D-2133-8 and ASP D-4181-88, having bulbous regions of a common diameter D1 in axially broad contact with each other within the central cavity of the housing to define a primary braking surface therebetween of area $$\pi\left(\frac{D1}{2}\right)^2.$$

The reduced regions of diameter D2 of the clutch disks face in opposite directions each extending longitudinally of the housing from a shoulder region to a remote end segment. The remote end segment of one of the reduced regions, extends from the shoulder region through a secondary braking washer of annular cross section also of a plastic composite as identified above, to define a secondary braking surface equal to $$\pi\left[\left(\frac{D1-D2}{2}\right)\right]^2$$

(where D1 and D2 are the exterior and interior diameters of the secondary braking washer). The modified torque limiting subassembly can be driven by a conventional cordless drill using its chuck to attach thereto or by a electrical motor within a unitary housing.

DETAILED DESCRIPTION OF THE INVENTION

Figure 1:
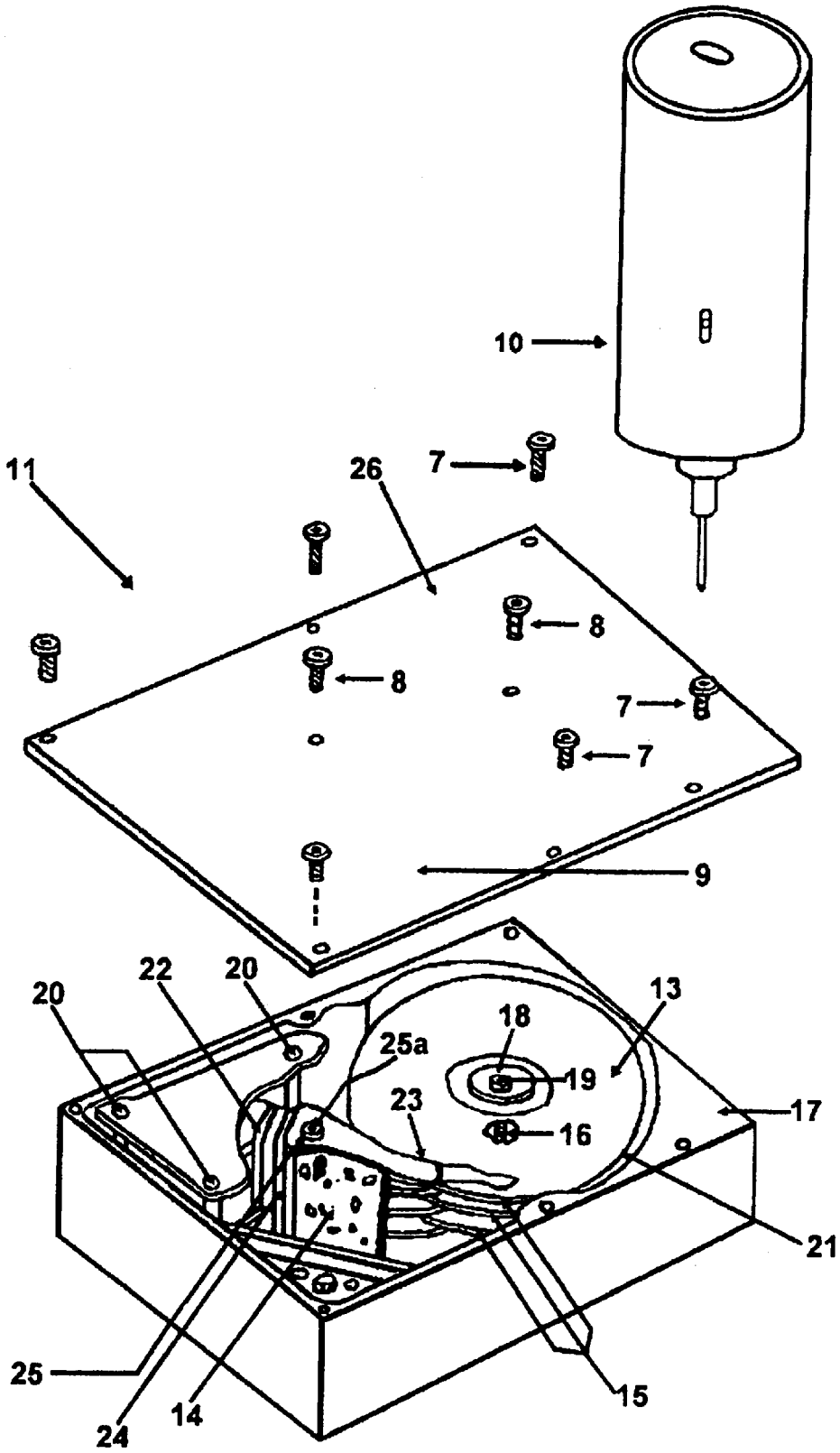
FIG. 1 is a perspective view of a torque limiting production tool in use in disc drive assembly operations.
Figure 2:
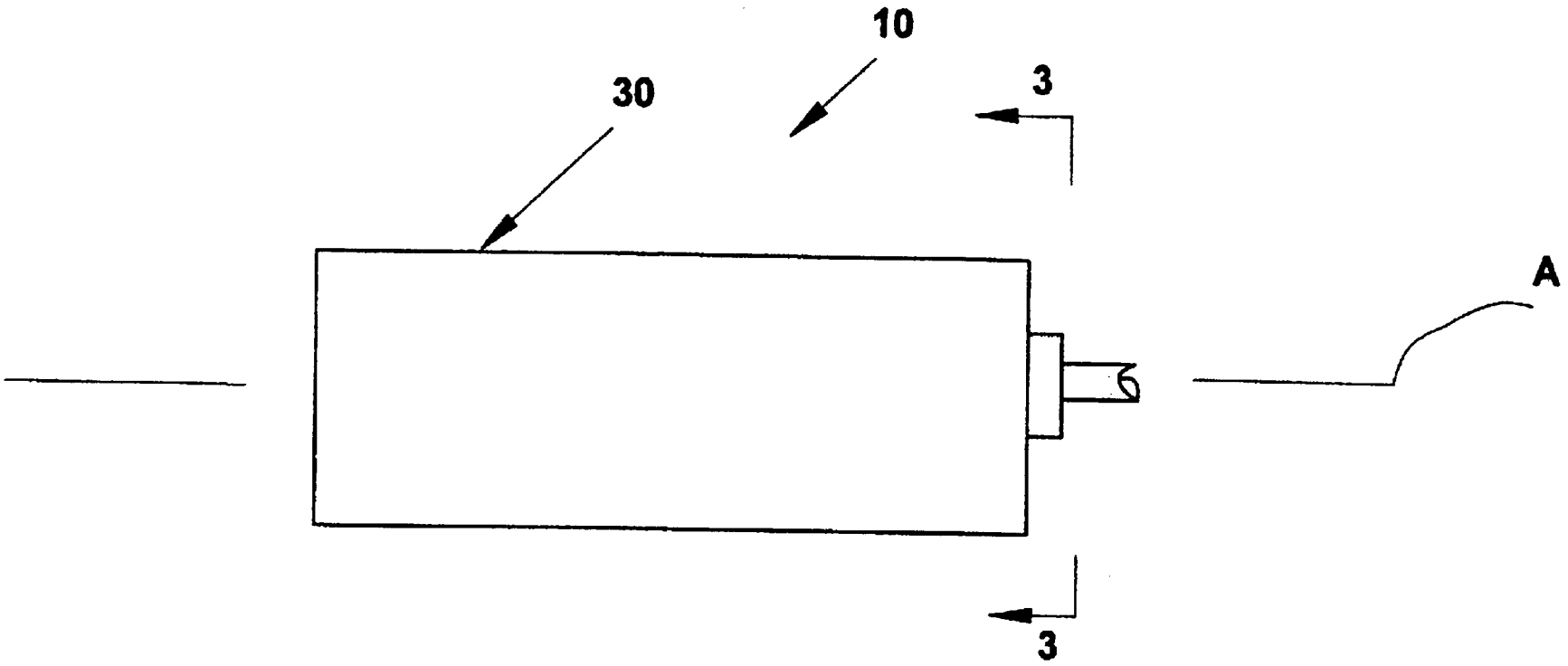
FIG. 2 is a side view of the torque, and shock limiting tool of FIG. 1.

FIG. 1 shows torque limiting production tool 10 in use in associated with a disc drive assembly 11. The disc drive assembly 11 includes a disk storage system generally indicated at 13, and a READ-WRITE head assembly 14. The disk storage system 13 includes a series of magnetic disks 15 stacked horizontally on a central shaft 16 within a central housing 17. Rotation of the series of magnetic disks 15 and central shaft 16 is via a drive motor (not shown) rotationally attached to the central shaft 16 opposite to fastener assembly 18 that includes assembly nut 19. The head assembly 14 is attached to the housing 17 by fasteners 20 and includes READ-WRITE magnetic sensors 21 operationally linked to mechanical drivers 22 via cantilevered arms 23. The cantilevered arms 23 also includes a transverse shaft 24 parallel the central shaft 16, the transverse shaft 24 being attached to the arms 23 via fasteners assembly 25 including nut 25*a*. After the disk storage system 13 and READ-WRITE head assembly 14 have been assembled within the central housing 17, a cover 26 is releasably attached by cover screws 7. Separate stabilizing screws 8 are attached to the shafts 16, 24 through the broad surface 9 of the cover 26 to stabilize shaft operations. Critical to performance of the disc drive assembly 11 is the use of preset micro-torque values on the production line, such values to be used as standards in tightening down stabilizing screws 8, cover screws 7, fastener assemblies 18, 25 including nuts 19, 25*a* and fasteners 20. Note that after such preset micro-torque values are calculated by engineers, the production personnel preset same into the production tool 10 of the invention that will be used on the production line for such operation. Result: highly accurate and repeatable achievement of the preset micro-torque values while substantially reducing and limiting the generation of shock waves through the hardware during torquing operations.

FIGS. 2–5 show the production tool 10 in more detail.

As shown, the tool 10 includes a longitudinal axis of symmetry A and a hollow cylindrical handle 30 that is metallic and annularly shaped. The cylindrical handle 30 comprises a side wall 31 concentric of the axis of symmetry A, such side wall 31 being more open at end wall surface 32 than at more closed end wall surface 33. The side wall 31 (see FIG. 5) also includes central main cavity 34 defined by a diameter D1 and inner surface 34*a* constant from the more open end surface 32 until shoulder 35*a* of far end wall 35 is encountered wherein the diameter D1 of cavity 34 is reduced to a diameter D2, i.e., far end wall 35 is provided a central opening 36 in communication with the main central cavity 34, such central opening 36 being of diameter D2 also being concentric of axis of symmetry A. As shown, D1 is greater than D2.

Figure 3:
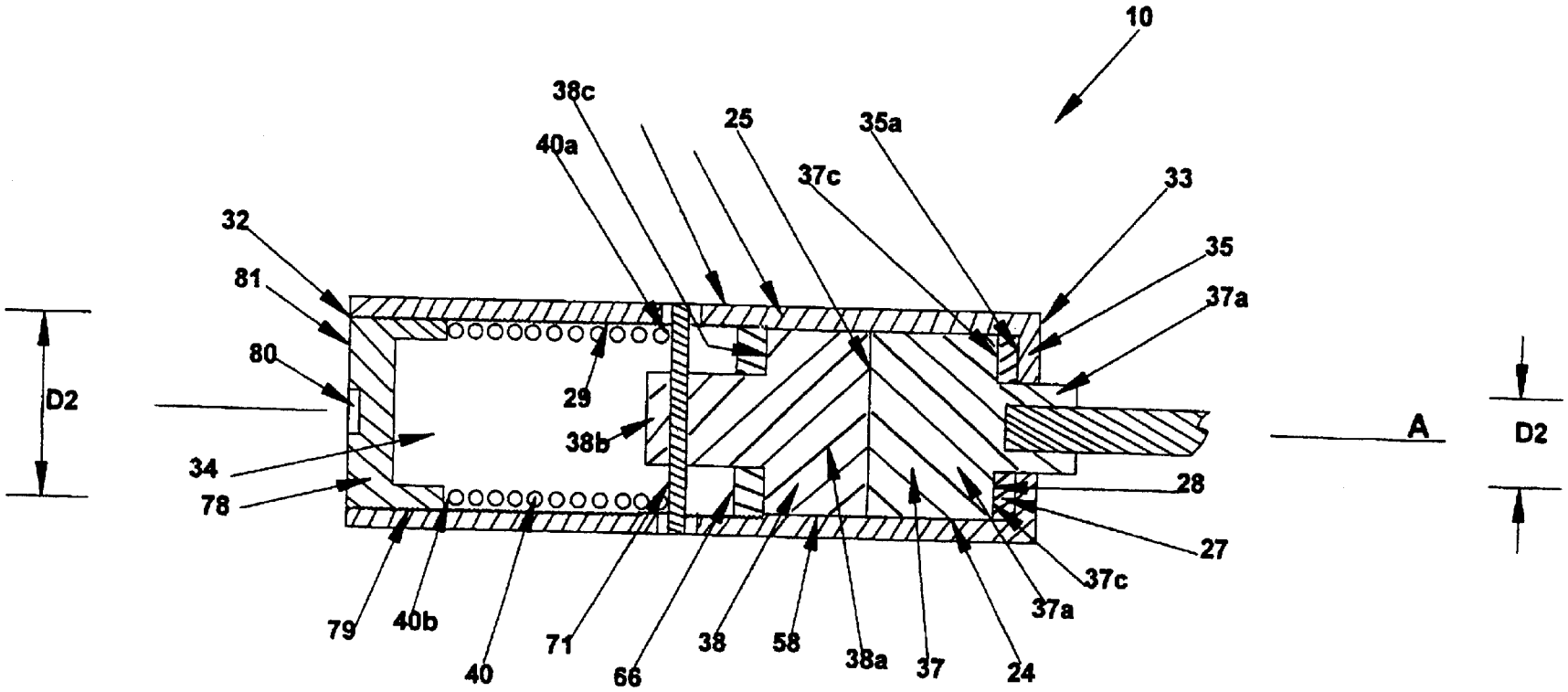
FIG. 3 is a section taken along line 3—3 of FIG. 2.

Adjacently positioned to the more closed end wall surface 33 but within the main central cavity 34 of the handle 30, see FIG. 3, is a clutch mechanism generally indicated at 27 concentric of the axis of symmetry A.

The clutch mechanism 27 is seen to include a driving clutch plate 37 of circular cross section having a bulbous region 37*a* in broad surface contact with a bulbous region 38*a* of a primary brake clutch plate 38 to create a primary braking surface generally indicated at 28*a* that is normal to and is bisected by the axis of symmetry A. The driving clutch plate 37 also includes a reduced diametered remote end region 37*b* opposite to the bulbous region 37*a* where shoulder region 37*c* marks the separation of the bulbous region 37*a* from the reduced remote end region 37*b*. Such shoulder region 37*c* is longitudinally positioned adjacent to the shoulder 35*a* of the end wall 35 of the handle 30, and as shown is axially separated therefrom by the presence of a secondary brake plate 29 of annular shape. The purpose of the secondary brake plate 29: to create a secondary braking surface generally indicated at 28*b* parallel to the primary braking surface 28*a* wherein a composite friction force for these braking surfaces 28*a*, 28*b*, is created by compression spring 40, as explained in more detail below.

Figure 4:
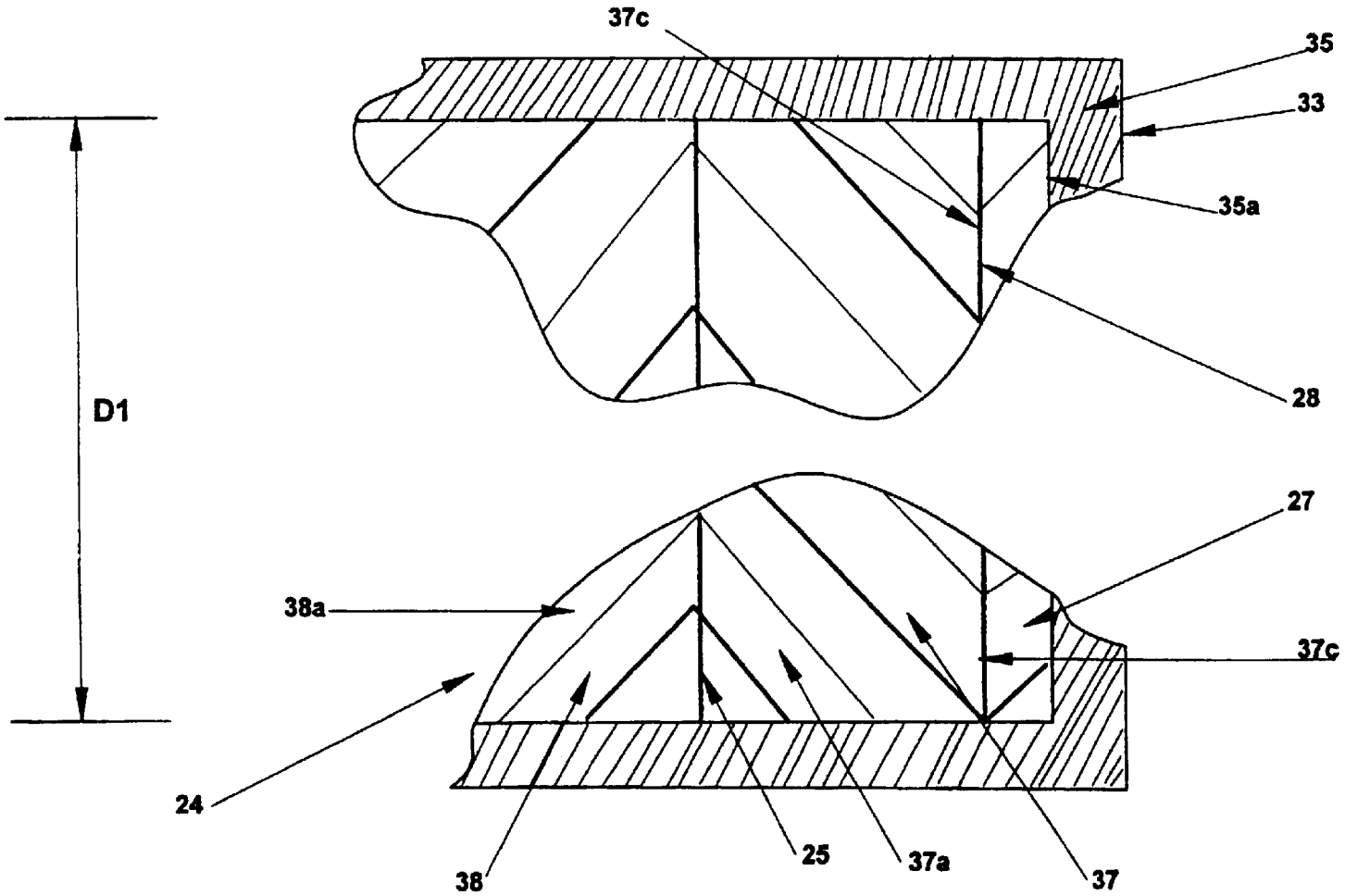
FIG. 4 is a fragmentary side view of clutch mechanism of the invention of FIG. 3 enlarged to better indicate relevant elements positioned near a remote end thereof.
Figure 5:
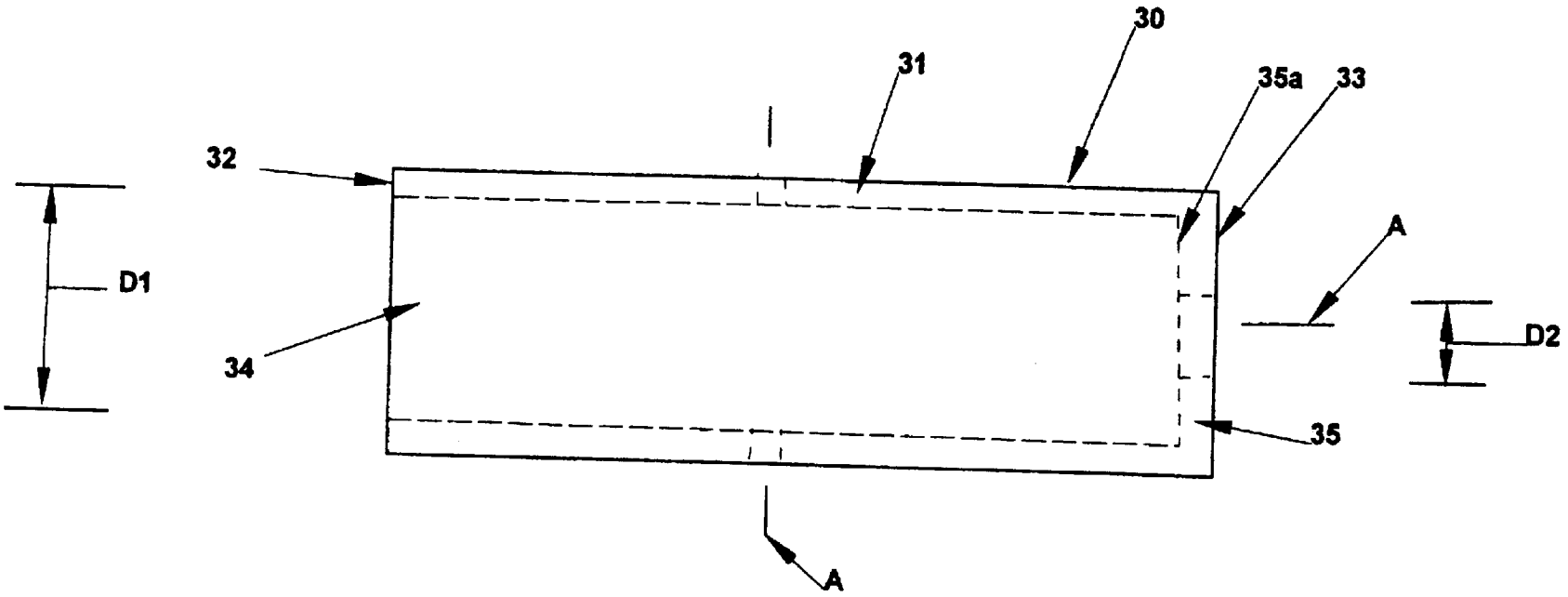
FIG. 5 is a detail side view of the handle of the production tool of the invention.

The bulbous region 37*a* of the driving clutch plate 37 has a circumferentially extending outer surface 37*d*, see FIG. 4, in radial broad contact with interior surface 34*a* of the side wall 31 of the handle 30 so that the compression force of the spring 40, FIG. 3, is longitudinally confined. The reduced diametered end region 37*b* of the clutch plate 37, see FIG. 6, includes a mid-segment 41 that includes an outer surface 42 and an end segment 43. Note the outer surface 42 of the segment 41 is placed in radial contact with wall surface 36*a*, see FIG. 5, of the opening 36 in the end wall 35 of the handle 30. The diameter of the mid segment 41 and of the end segment 43 is constant and equal to diameter D2. That is, such diameter D2 is constant—longitudinally speaking—from the shoulder region 37*c* to the end segment 43.

Note that the end segment 43 of the reduced end region 37*b* of the clutch plate 37 is defined by a distance L1 and terminates in an end surface 44. Such end surface 44 is seen to be penetrated by a central opening 45. Note in FIG. 3 that central opening 45 in the reduced end region 37*b* provides a press fit with bit 50.

Bit 50 is conventional and includes a hexagon shaped base and can be fitted to an opposite end with any appropriate driver such a Phillips, regular blade for screws and the like or sockets for nuts and the like.

Figure 10:
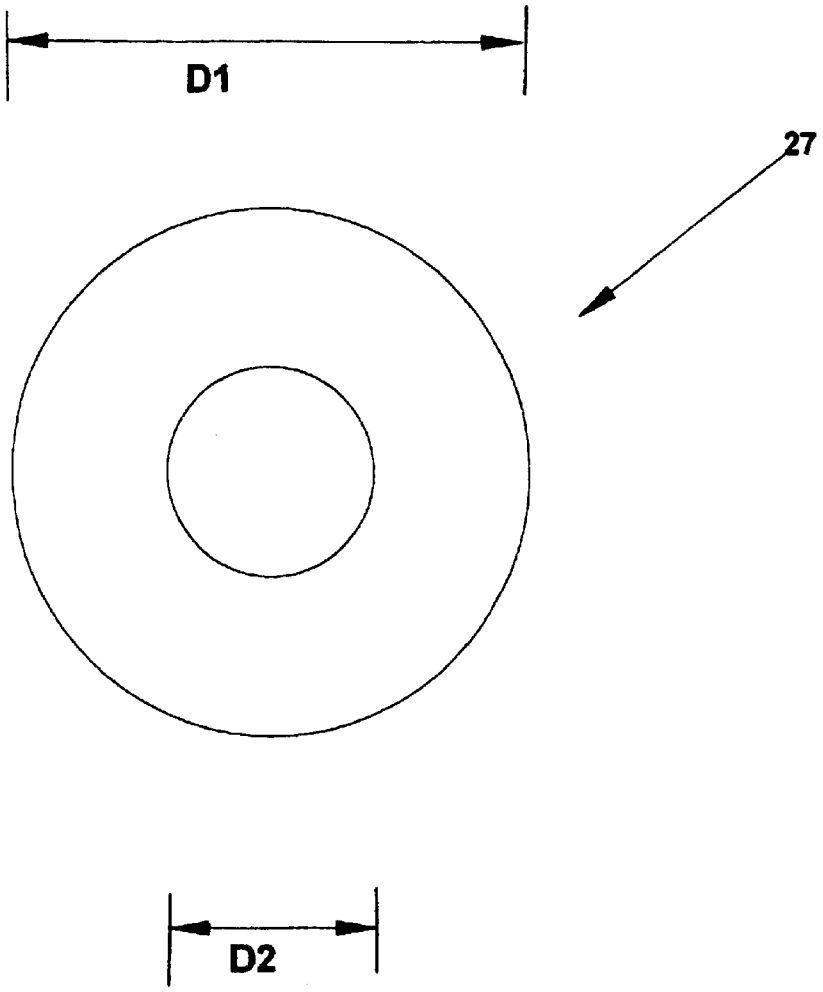
FIG. 10 is a front detail view of the secondary braking clutch plate of the clutch mechanism of FIG. 4.

As previously mentioned, the shoulder region 37*c* of the driving clutch plate 37 is longitudinally positioned adjacent to the shoulder 35*a* of the end wall 35 of the handle 30, and as shown is axially separated therefrom by the presence of the secondary brake plate 29 of annular shape. That is, the shoulder region 37*c* does not contact shoulder 35*a* of the end wall 35. Instead, annularly shaped secondary braking plate 29 is positioned in contact with both the shoulder region 37*c* and the shoulder 35*a*. Its purpose: to provide the secondary braking surface 28*b* previously mentioned equal to $$\pi\left[\left(\frac{D1-D2}{2}\right)\right]^2,$$

see FIG. 10

Figure 6:
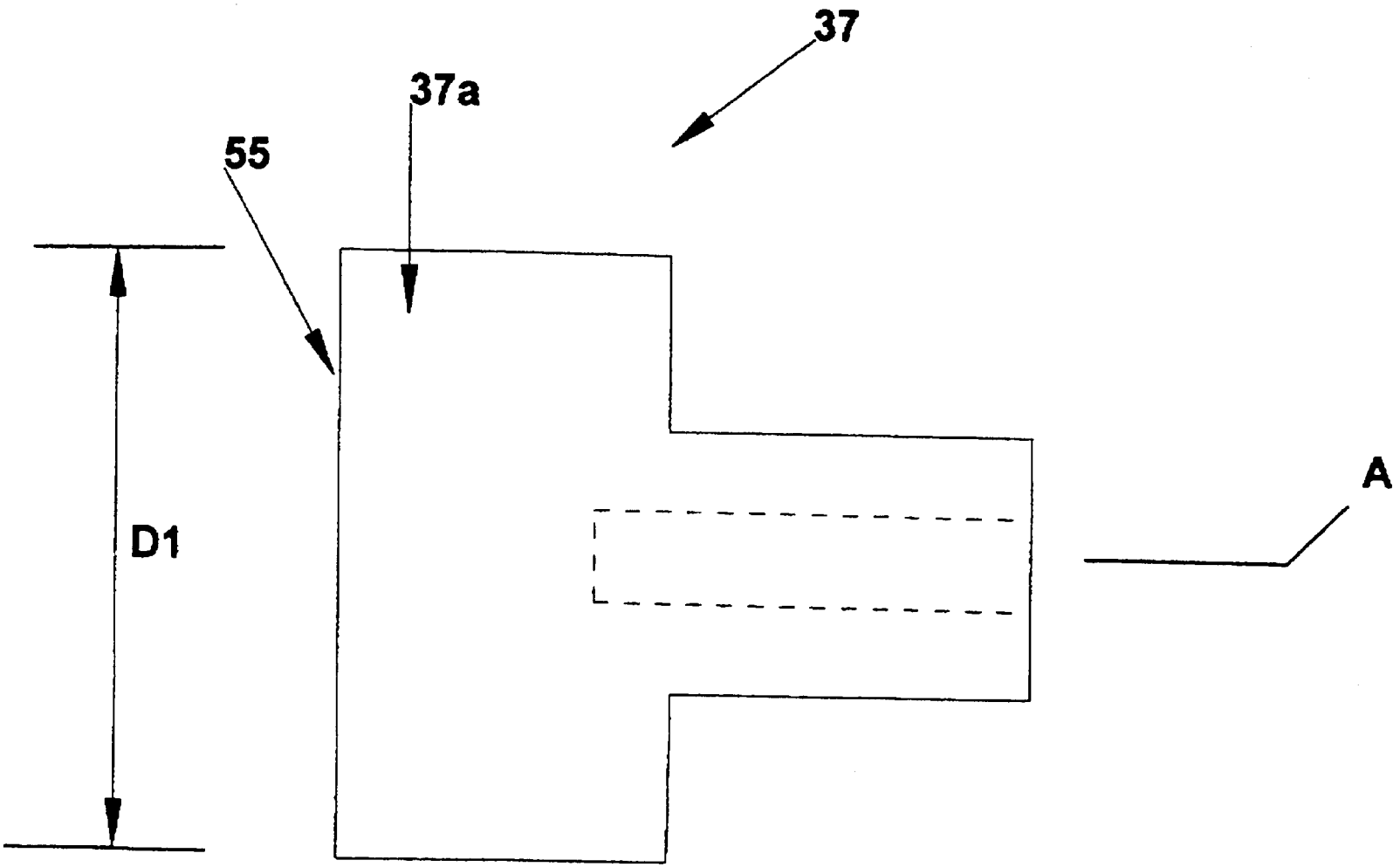
FIG. 6 is a detail side view of the driving clutch plate of the clutch mechanism of FIG. 4.

Note that toward the mid region of the handle 30, the bulbous region 37*a* of the driving clutch plate 37 is provided with a diameter D1. As shown in FIG. 6, the bulbous region 37*a* terminates in a continuously extending end surface 55 transverse to the axis of symmetry A. Such diameter D1 of the end surface 55 is designed to match that of similarly sized bulbous region 38*a* of the brake clutch plate 38, see FIG. 3, to create the primary braking surface 28*a* previously mentioned. In that way broad surface contact is provided across the entire extent of transverse end surface 55 of the drive clutch plate 37 as wall as along adjacent transverse end surface 57 (see FIGS. 7 and 8) of the bulbous region 38*a* of the brake clutch plate 38 wherein the friction force acting between the end surfaces 55, 57 (a function of the compression force of the spring 40) can be accurately related to a preset micro-torque value. Likewise, the area of the primary braking surface 28*a* is related to the diameter D1 of the end surfaces 55, 57 in accordance with $$\pi\left(\frac{D1}{2}\right)^2.$$

Figure 7:
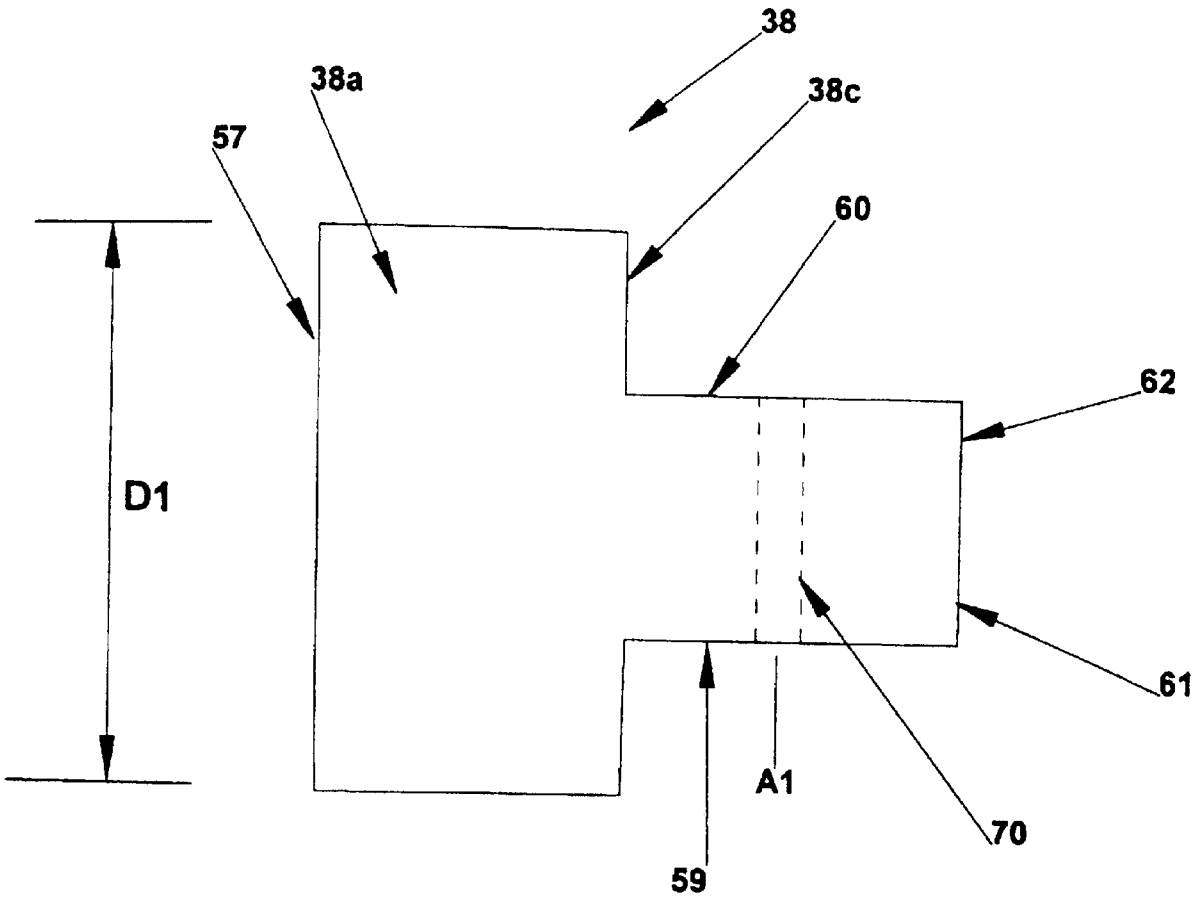
FIGS. 7 and 8 are detail side and top views, respectively, of the primary braking clutch plate of the clutch mechanism of FIG. 4.
Figure 8:
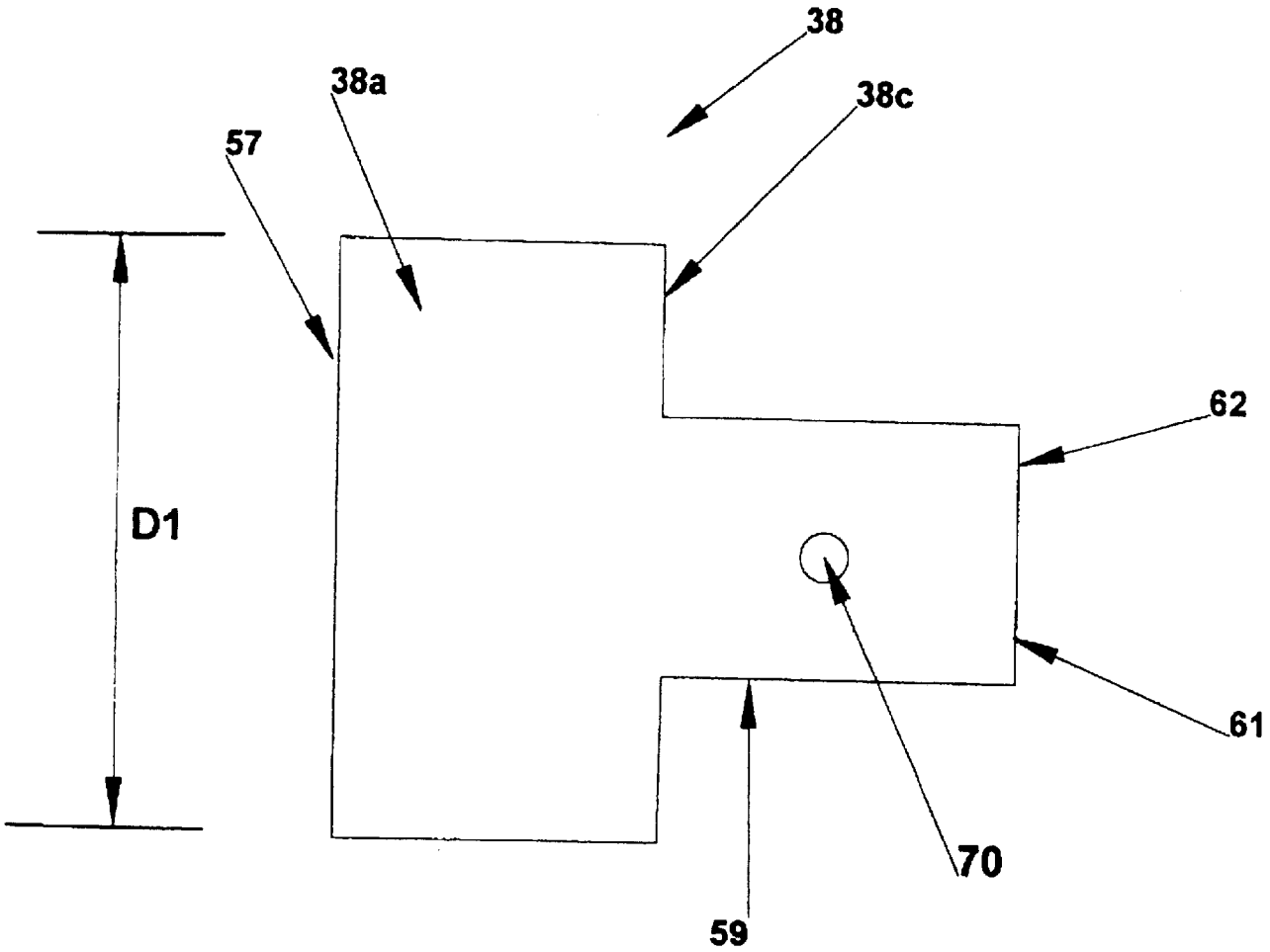

Bulbous region 38*a* of the primary brake clutch plate 38 has a circumferentially extending outer surface 58, see FIGS. 3, 7 and 8 defined by diameter D1 in radial broad contact with interior surface 34*a* of the side wall 31 of the handle 30 so as to be longitudinally confined. The reduced diametered end region 38*b* of the clutch plate 38 extends from shoulder region 38*c* that marks the separation of the bulbous and reduced diametered regions 38*a* and 38*b* and includes a mid segment 59 (see FIGS. 7 and 8) that includes an outer surface 60 and an end segment 61 that includes an end surface 62. The diameter D2 of the end region 38*b* is constant—longitudinally speaking—from the shoulder region 38*c* to terminating end surface 62.

Figure 9:
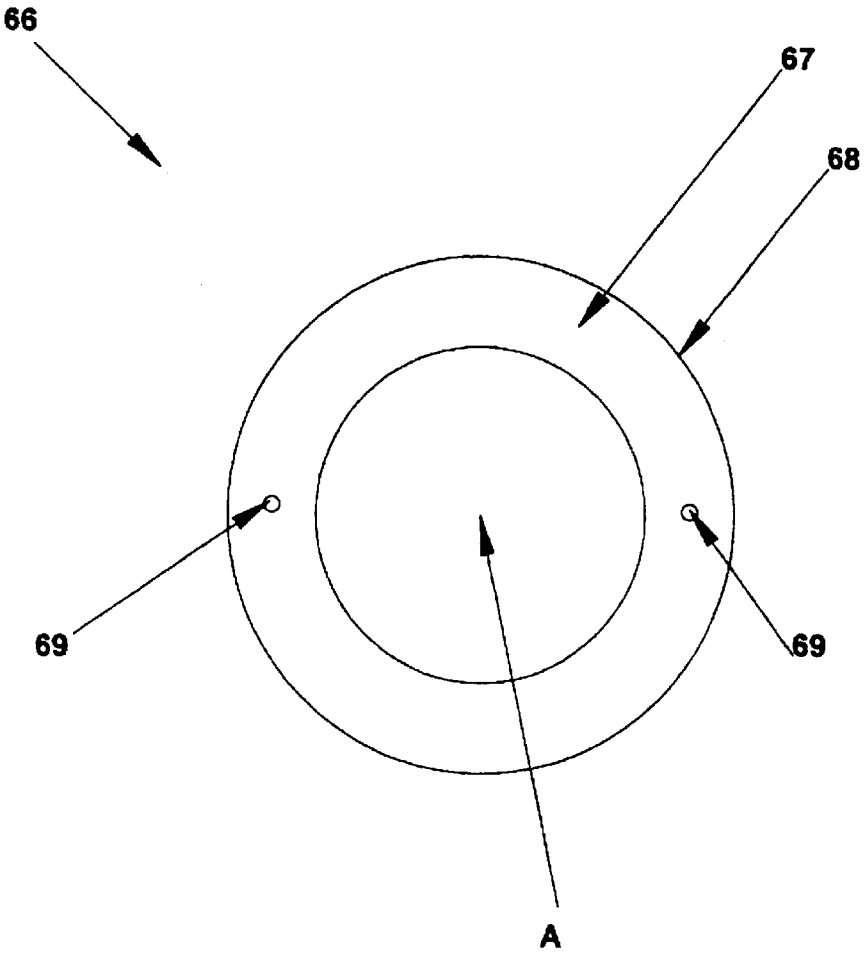
FIG. 9 is a front detail view of the retaining ring of the clutch mechanism of FIG. 4.

Returning to FIG. 3, in broad contact with the shoulder region 38*c* of the braking plate 38, is an annularly shaped retaining ring 66. As shown best in FIG. 9, note that the retaining ring 66 includes a side wall 67 radially terminating in circumferentially extending surface 68 that includes threads (not shown), such retaining ring 66 being capable of rotation in operative contact with associated threads (not shown) at the inner surface 34*a* of the side wall 31 of the handle 30 of FIG. 5 and rectilinear movement along the axis of symmetry A. Such action is provided by inserting a tip of a tool (not shown) into a pair of openings 69 in the side wall 67 of the retaining ring 66.

Returning to FIG. 3, note that the amount of rectilinear advancement of the retaining ring 66 along to the side wall 31 of the handle 30 toward the shoulder 35*a* of the far end wall 35 of the handle 30, establishes a minimum retaining set point for the primary brake pair 38, the drive plate 37 and the secondary brake plate 29 relative to the aforementioned shoulder 35*a* of the end wall 35 of the handle 30.

Figure 11:
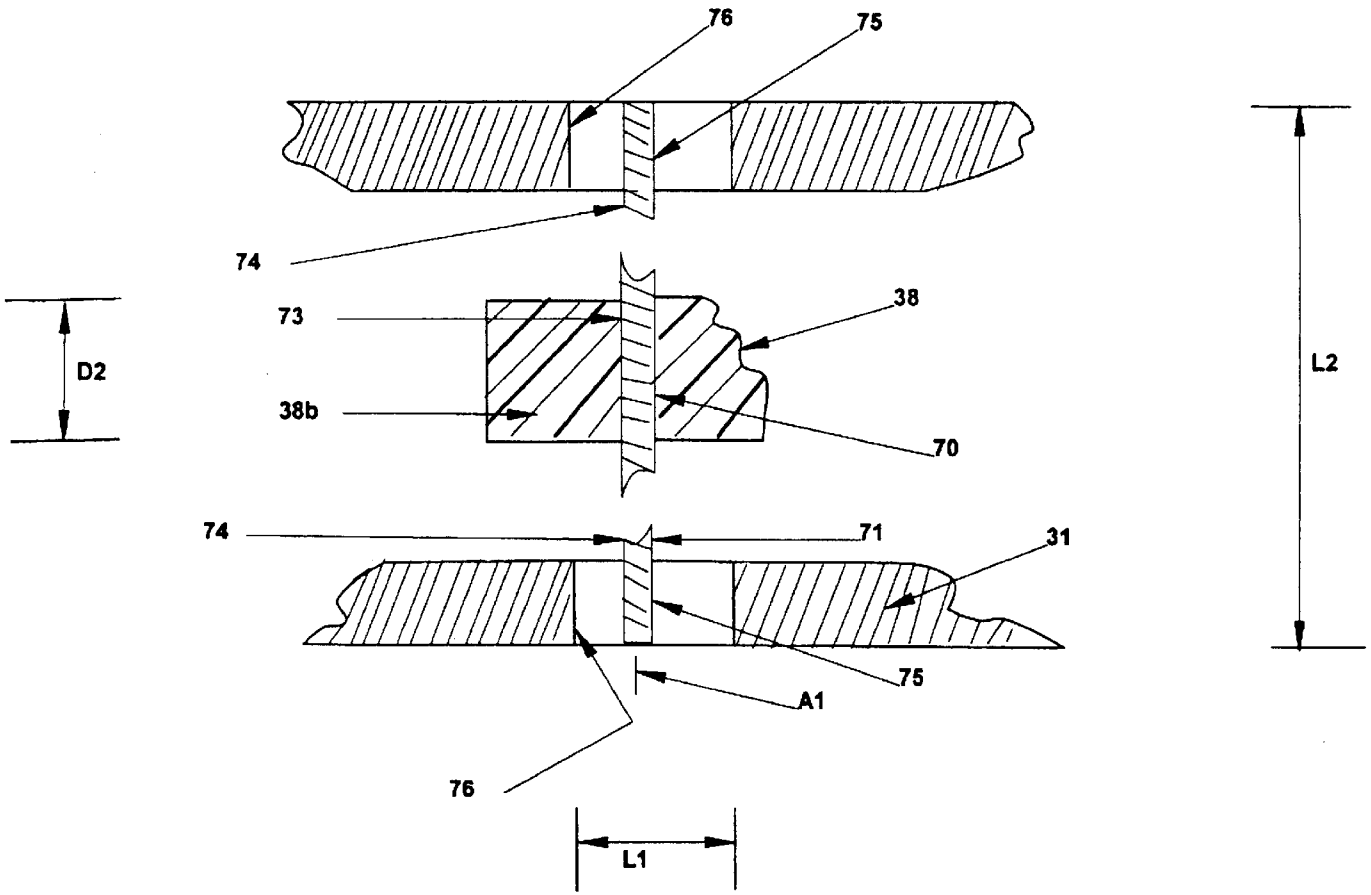
FIG. 11 is a fragmentary side view of the primary braking clutch plate clutch mechanism of the invention of FIG. 3 enlarged to better indicate relevant elements positioned near the mid-portion thereof.

Also provided within remote end region 61 of the reduced region 38*b* of the braking (see FIGS. 7, 8 and especially 11) is a transverse opening 70 having an axis of symmetry A1 normal to the axis of symmetry A of the tool 10. Such transverse opening 70 is constructed to slidably accept a transverse pin 71 having a transverse length of L2 greater than D1, see FIG. 11. The transverse length L2 of the pin 71 is designed to provide a central region 73 that resides within opening 70, a pair of extension regions 74 exterior of the opening 70 and end regions 75 that extend through diametrically opposed slots 76 in the side wall 31 of longitudinal length L3, each having a width matched to that of the diameter of the pin 71 to establish rotational integrity between the pin 71 and the handle 30.

Returning to FIG. 3, note that extension region 74 of pin 71 accepts into contact therewith, a first interior end coil 40*a* of the compression spring 40. While, at the opposite end, a second exterior end coil 40*b* of the spring 40 is seen to be in broad contact with planar end cap 78. The end cap 78 is seen to comprise radial side surface 79 that is fully threaded to releasably attach to the interior surface 34*a* of the side wall 31 of the handle 30. The end cap 78 is longitudinally positioned adjacent to the more open end wall surface 32 of the handle 30 and is permitted to undergo rectilinear travel toward the shoulder 35*a* of the end wall 35 of the handle 30 to establish a highly accurate micro-torque value based on the compression force engendered by the compression spring 40 trapped between the end cap 78 and the pin 71.

Engineeringwise, length L3 (see FIG. 11) of the slots 76 permit such longitudinal rectilinear movement of the end regions 75 of the pin 71 (and hence the primary braking plate 38). As previously stated with regard to FIG. 3, such movement is relative to the shoulder 35*a* of the far end wall 35 of the handle 30, and results, of course, from the controlled rotation of the end cap 78 via insertion of tool tip (not shown) in a slot 80 in broad surface 81 of the end cap 78 to provide micro-torque adjustment in establishing preset micro-torque values for the tool of the invention. Such adjustment results in part, by the fact that both primary and secondary braking surfaces 28*a*, 28*b* substantially increase the maximum friction force available for adjustment while substantially reducing friction among the primary tool elements, viz., primary brake plate 38, disc drive plate 37 and secondary braking plate 29.

It is apparent that the materials used in the manufacture of the tool 10 of the invention, is of importance. In this regard, the primary brake plate 38, drive plate 37 and secondary braking plate 29 are formed of a high impact plastic having a low coefficient of friction such as a composite or blend of teflon fluorocarbon and acetal resin identified with Federal Regulations and/or Specifications LP 392 A-type 2, ASP D-2133-8 and ASP D-4181-88, an example thereof being Delrin 100 AF, a trademark of E.I. DuPont de Nemour & Company, Wilmington, Del., having the following physical characteristics:

- Coefficient of friction: 0.14 using thrust washer test at 10 FPM at 300 psi versus carbon steel finished to 16 um, although a range of 0.08 to 0.20 is adequate for the invention;
- Coefficient of linear thermal expansion: 3.8×10** in/in using ASTM test 696 for a temperature range of −40 to 85 degrees F.;
- Specific gravity: 1.54 using ASTM test 792;
- Rockwell hardness: M78, R110 using ASTM test 785;
- Tensile Elongation using ASTM test 638: 22 at 73 degrees F. and at rate of 0.2 in/min;
- Tensile Strength using ASTM test 638: 7.6 Kpsi at 73 degrees F. and rate of 0.2 in/min;
- Modulus of Elasticity using ASTM test 638: 420 Kpsi at 73 degrees F and a rate of 0.2 in/min;
- Shear Strength using ASTM test 732: 8 Kpsi at 73 degrees F.;
- Flexural modulus using ASTM text 790: 340 Kpsi at 73 degrees F. and a rate of 0.05 in/min;
- Flexural Yield Strength using ASTM test 790: 10.5 Kpsi at 73 degrees F. and a rate of 0.05 in/min;
- Compressive Stress using ASTM test 695; 4.5 Kpsi at 73 degrees F., 1 percent deflection and a rate of 0.05 in/min as well as 13 Kpsi at 73 degrees F., 10 percent deflection and a rate of 0.05 in/min;
- Deformation using ASTM test 621: 0.6 percent under load of 2000 psi at 122 degrees F.;
- Impact using ASTM test 256: 1.2 ft. lb/in at 73 degrees F.; and
- Tensile Impact Resistance using ASTM test 1822: 50 ft. lb/in at 73 degrees F.

Likewise the handle 30 is preferably metallic such as polished aluminum; the end cap 76 is also metallic such as stainless steel; and the retaining ring 66 is also metallic also stainless steel.

In this regard, the tool 10 has been built as described above and been successfully tested in the following manner. The tool 10 of the invention was preset with a micro-torque value and then used to torque down a nut on a threaded shaft similar to that depicted in FIG. 1, such preset micro-torque value being to an accuracy within −+1.5 percent deviation.

During torquing operations, the loading on such nut was linearly increased with time (without steps) and without generating shock therealong. With the tool 10 of the invention attached to the nut, the tool 10 was checked to a milling machine while the shaft was fixedly attached to the milling machine table. Then the machine was rotated at 100 rpm for less than 45 minutes whereby the bit 50 and drive clutch plate 37 remained stationary as the handle 30, primary braking clutch plate 38 and secondary braking plate 27 rotated at the aforementioned 100 rpm. Such test is equivalent, it is believed to about 2 years of service of the tool in production operation. Then the tool 10 and shaft was removed from the milling machine, and the tool 10 re-tested as to preset micro-torque value. Such value still had an accuracy within −+1.5 percent deviation.

From the foregoing, it will be appreciated that one skilled can make various modifications and changes to the invention within the spirit and scope of the disclosure. Differing modifications are presented in detail below.

MODIFICATIONS

Figure 12:
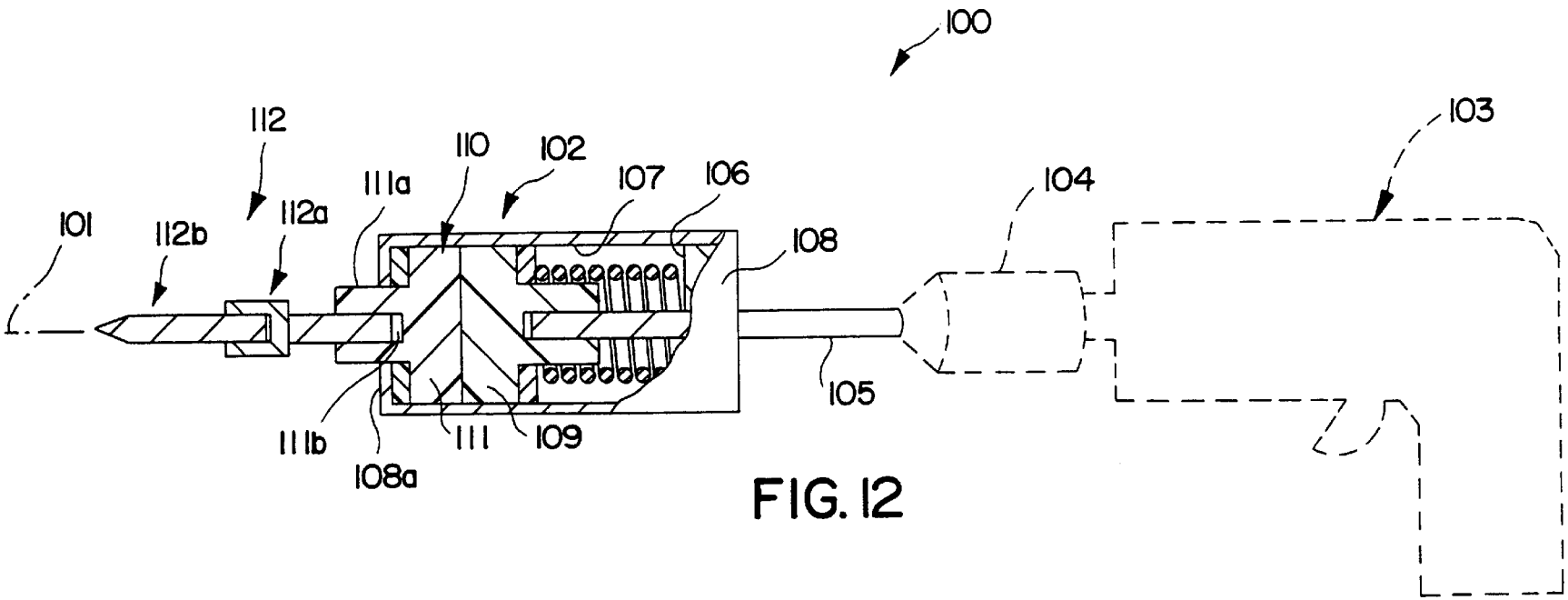
FIG. 12 is a side view—partially cut-away—of an improved torque limiting production tool in use in disc drive assembly operations wherein a conventional cordless drill with chuck, is attached to a modified torque limiting subassembly constructed in accordance with the invention.

FIG. 12 is a side view—partially cut away—of an improved torque limiting production tool 100 to be used in the same manner as hereinbefore explained, say for use in construction of the disc drive assembly 11 of FIG. 1 that aid in the assembly of the disk storage system generally indicated at 13, and the READ-WRITE head assembly 14 as there described.

As shown, the tool 100 includes a longitudinal axis of symmetry 101 bisecting a modified torque limiting subassembly 102 constructed in accordance with the invention, attached to a conventional cordless drill 103 with chuck 104, via a drill stem 105. The drill stem 105 is concentric of axis of symmetry 101 and extends through an adjusting ring 106 movable with respect to side wall 107 of cylindrical housing 108 and is seen to attach to a drive clutch disk 109 of torque limiting mechanism 110.

As shown, in addition to drive clutch disk 109, the torque limiting mechanism 110 also includes a driven clutch disk 111 in surface contact with the drive clutch disk 109 having a reduced region 111*a* extending through end wall 108*a* of housing 108. The reduced region 111*a* of the driven clutch disk 111 includes a central opening 111*b* that receives a conventional bit holder assembly 112 comprising a bit holder 112*a* and a bit 112*b*.

Bit holder 112*a* is conventional and includes a hexagon shaped base and can be fitted at an opposite end with any appropriate driver bit 112*b* which can be a Phillips or of a rectangular blade for driving screws and the like or of the socket type for nuts and the like.

Figure 13:
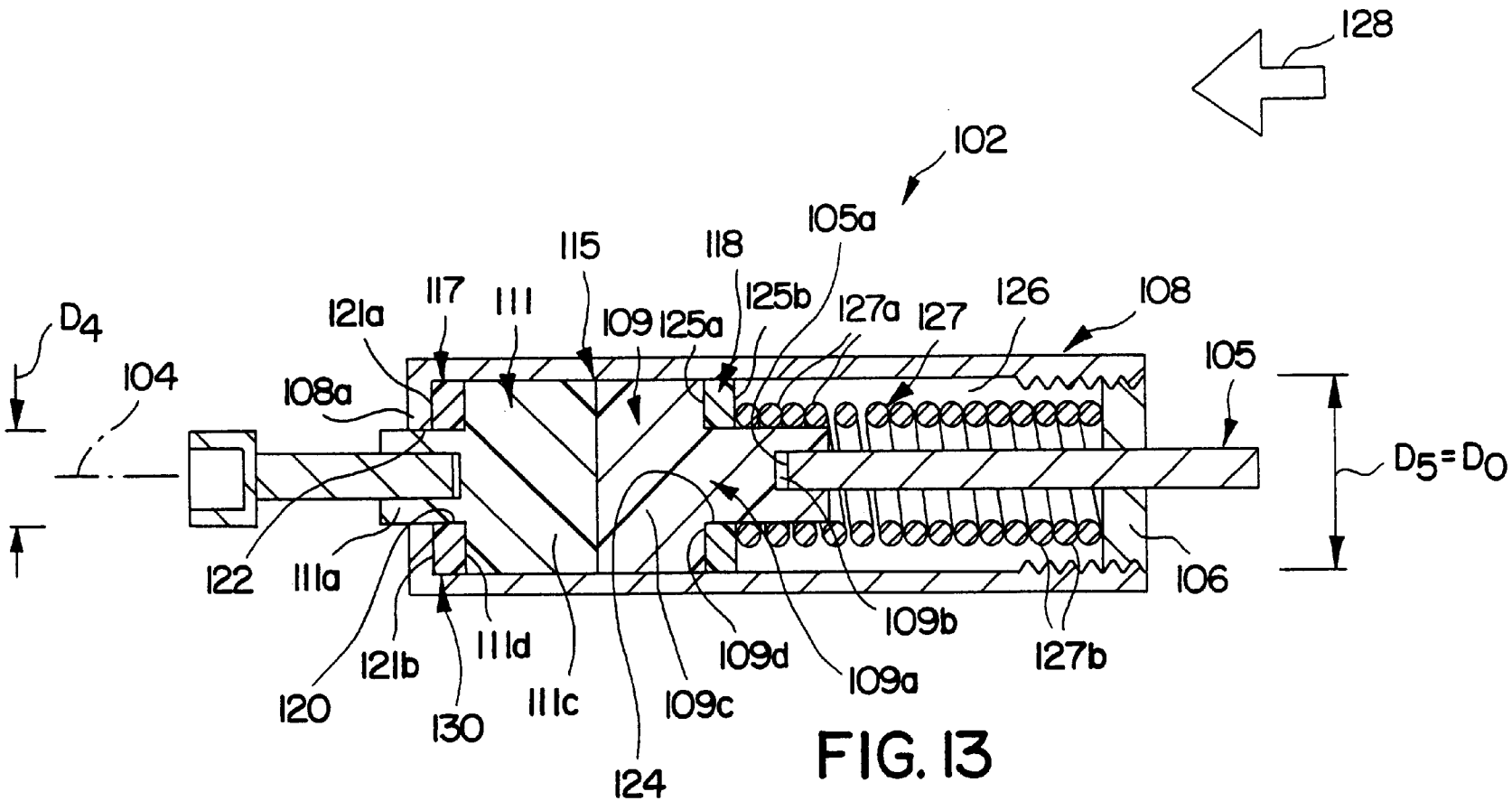
FIG. 13 is a longitudinal section of the torque limiting subassembly of FIG. 12.

In FIG. 13, the torque limiting subassembly 102 constructed in accordance with the invention, is depicted in detail.

As shown, the drive clutch disk 109 has a reduced region 109*a* having an opening 109*b* into which end 105*a* of drill stem 105 resides and a bulbous region 109*c* in broad surface contact with bulbous region 111*c* of the driven clutch disk 111 to create a drive-driven contact zone generally indicated at 115 that is normal to and is bisected by the axis of symmetry 101 wherein the area of the primary braking is related to the diameter D5 of the bulbous regions 109*c*, 111*c* in accordance with $\pi(D5/2)^2$.

The drive clutch disk 109 includes a shoulder 109*d* separating the reduced region 109*a* from the bulbous region 109*c*. Similarly, a shoulder 111*d* defines and separates the reduced region 111*a* from the bulbous region 111*c* of the driven clutch disk 111. Such shoulders 109*d* and 111*d* are seen to be contact with stabilizing washers 117 and 118, respectively, and are longitudinally positioned as follows:

(i) the washer 117 has an opening 120 through which the reduced region 111*a* of the driven clutch disk 111 penetrates; a first broad surface 121*a* in contact with end wall 108*a* of the housing 108; and a second broad surface 121*b* in contact with the shoulder 111*d* of the driven disk 111 and (ii) the washer 118 has an opening 124 through which the reduced region 109*a* of the drive clutch disk 109 penetrates; a first broad surface 125*a* in contact with the shoulder 109*d* of the driving clutch disk 109; and a second broad surface 125*b* in loading contact with first end 127*a* of a compression spring 127. Second end 127*b* of the compression spring 127 is in contact with adjusting cap 106 wherein rectilinear movement of the latter in the direction of arrow 128 increases the loading upon the drive-driven contact zone generally indicated at 115 as previously taught. Note that the diameter of the housing 108 is defined by a diameter Do at its more open end 108*b* and by a diameter D4 at the end wall 108*a* wherein opening 122 in end wall 108*a* is seen to be in communication with main central cavity 126 of the housing 108, such opening 122 being of diameter D4 also being concentric of axis of symmetry 101. As shown, Do is greater than D4. The diameter D4 also being equal to the diameter of the reduced region 111*a* of driven clutch disk 111.

Note that the stabilizing washer 117 forms a secondary braking zone generally indicated at 130 wherein a composite friction force is created by the compression spring 127, wherein the shoulder 111*d* of the clutch disk 111, is seen to be contact with stabilizing washer 117 which has a diameter about equal to diameter D5 of the enlarged regions 109*c*, 111*c* of drive and clutch discs 109,111, respectively. Purpose: to provide secondary braking surface 130 previously mentioned equal to $$\pi\left[\left(\frac{D5-D4}{2}\right)\right]^2.$$

Note that the drive and driven clutch disks 109, 111 and stabilizing washers 117, 118 are each formed of a plastic composite composed of teflon fluorocarbon and acetal resin in the manner previously mentioned. As a result, a linear loading torque function without undue shock generation as discussed hereinbefore can be easily provided.

Figure 14:
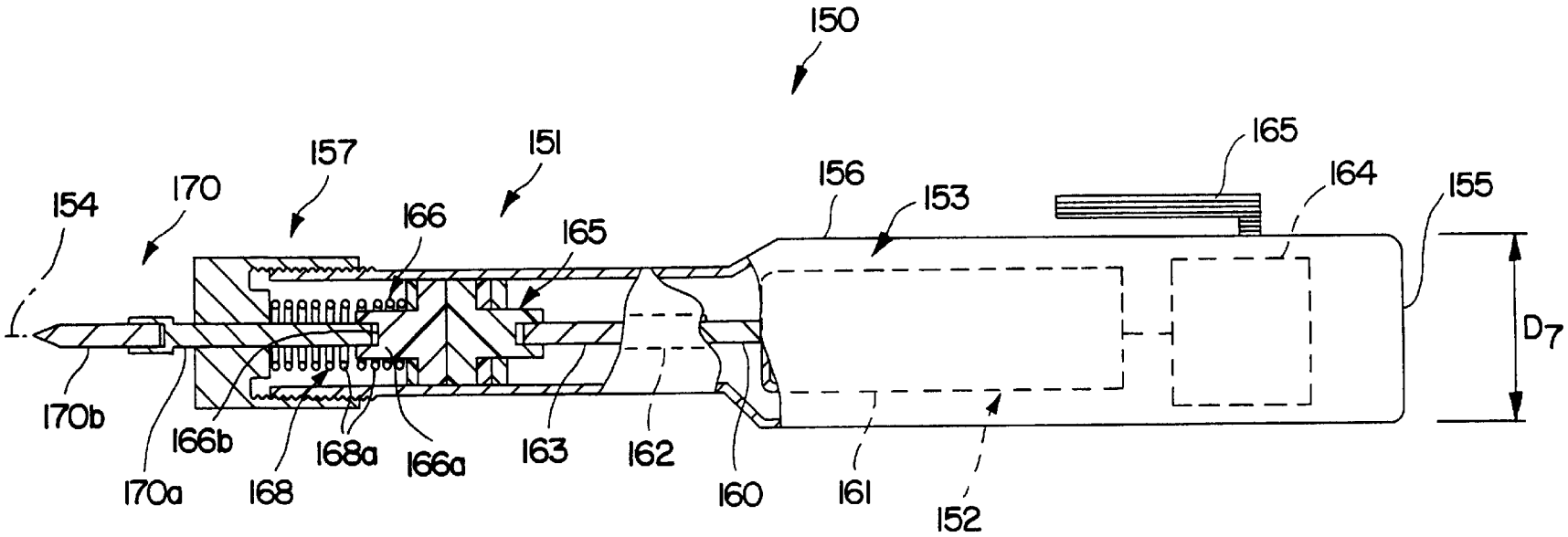
FIG. 14 is a side view—partially cut-away—of yet another improved torque limiting production tool in use in disc drive assembly operations wherein yet another torque limiting subassembly is depicted wherein it is combined with a separate drive unit within a unitary housing.

FIG. 14 is a side view—partially cut-away—of yet another improved torque limiting production tool 150 wherein yet another torque limiting subassembly 151 is depicted wherein it is combined with a separate drive unit 152 within unitary housing 153.

As shown, the tool 150 includes a longitudinal axis of symmetry 154 bisecting the modified torque limiting subassembly 151 constructed in accordance with the invention, attached the drive unit 152. The drive unit 152 comprises a power shaft 160 of motor 161 that drives the subassembly 151 through a universal joint 162 and driven shaft 163. Controller 164 functionally attaches to the controls the operations of the motor 161 as through palm switch 165 attached to the unitary housing 153 adjacent to end wall 155 thereof. The power shaft 160, motor 161, universal joint 162 and driven shaft 162 are preferably concentric of axis of symmetry 101 and reside in the bulbous region 156 of the housing 153. At open end 157 of the housing 153, resides torque limiting subassembly 151 of the invention wherein the driven shaft 163 of the drive unit 152 attaches to drive clutch disk 165 thereof.

As shown, in addition to drive clutch disk 165, the torque limiting mechanism 151 also includes a driven clutch disk 166 in surface contact with the drive clutch disk 165 having a reduced region 166*a* extending through end region 168*a* of compression spring 168 to retain the latter. The reduced region 166*a* includes a central opening 166*b* that receives a conventional bit holder assembly 170 comprising a bit holder 170*a* and bit 170*b*.

Bit holder 170*a* is conventional and includes a hexagon shaped base and can be fitted at an opposite end with any appropriate driver bit, such as bit 170*b* which can be a Phillips or of rectangular construction for driving screws and the like or of the socket type for nuts and the like.

Figure 15:
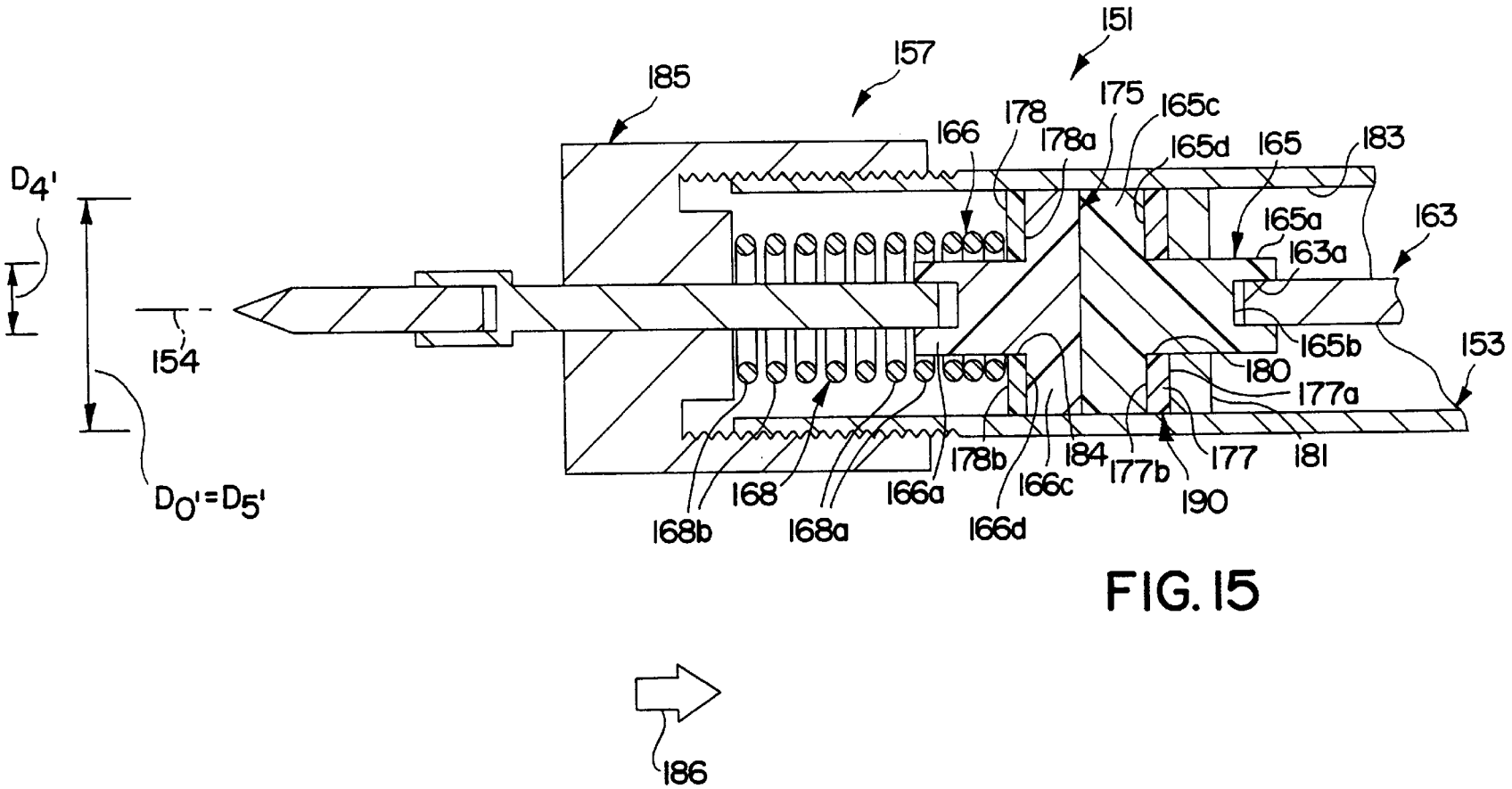
FIG. 15 is a longitudinal section of the torque limiting subassembly of FIG. 14.

Now refer to FIG. 15 where the torque limiting subassembly 151 constructed in accordance with the invention, is depicted in detail.

As shown, the drive clutch disk 185 has a reduced region 165*a* having an opening 165*b* into which end 163*a* of driven shaft 163 of drive unit 152 resides. The drive clutch disk 165 also includes a bulbous region 165*c* in broad surface contact with bulbous region 166*c* of the driven clutch disk 166 to create a drive-driven contact zone generally indicated at 175 that is normal to and is bisected by the axis of symmetry 154 wherein the area of the primary braking is related to diameter D5' of the bulbous regions 165*c* and 166*c* in accordance with $\pi(D5'/2)^2$.

The drive clutch disk 165 includes a shoulder 165*d* separating the reduced region 165*a* from the bulbous region 165*c*. Similarly, as to driven clutch disk 166, a shoulder 166*d* defines and separates the reduced region 166*a* from the bulbous region 166*c*. Such shoulders 165*d* and 166*d* are seen to be contact with stabilizing washers 177 and 178, respectively, and are longitudinally positioned as follows:

(i) the washer 177 has an opening 180 through which the reduced region 165*a* of the drive clutch disk 165 penetrates; a first broad surface 177*a* in contact with locking ring 181 which, in turn, is threadably attached to side wall 183 of housing 153 in the manner previously described; and a second broad surface 177*b* in contact with the shoulder 165*d* of the drive clutch disk 165 and (ii) the washer 178 has an opening 184 through which the reduced region 166*a* of the driven clutch disk 166 penetrates; a first broad surface 178*a* in contact with the shoulder 166*d* of the driven clutch disk 166; and a second broad surface 178*b* in loading contact with end region 168*a* of compression spring 168. Second end 168*b* of the compression spring 168 is in contact with adjusting cap 185 wherein rectilinear movement of the latter in the direction of arrow 186 increases the loading upon the drive-driven contact zone generally indicated at 175. Note that the diameter of the side wall 183 of the housing 153 is defined by a diameter Do' at its more open end 157 of the housing 153 and by a more enlarged diameter D7 adjacent to the end wall 155 of the same housing 153. As shown D7 is greater than Do'. Also, diameter D4' also defines the diameter of the reduced region 166*a* of driven clutch disk 166.

Note that the stabilizing washer 177 forms a secondary braking zone generally indicated at 190 wherein a composite friction force is created by the compression spring 168, wherein the broad surface 177*a* of the washer 177, is seen to be contact with locking ring 181. Note that the diameter of the stabilizing washer 177 is about equal to the diameter D5' of the enlarged regions 165*c*, 166*c* of drive and clutch discs 165, 166, respectively. Purpose: to provide secondary braking surface 190 previously mentioned equal to $$\pi\left[\left(\frac{D5' - D4'}{2}\right)\right]^2.$$

Note that the drive and driven clutch disks 165, 166 and stabilizing washers 177, 178 are each formed of a plastic composite composed of teflon fluorocarbon and acetal resin in the manner previously mentioned. As a result, a linear loading torque function without undue shock generation as discussed hereinbefore, can be easily provided.

In addition, note that the subassembly 151 of FIG. 15 could also be used in association with the conventional drill 103 with chuck 104 of FIG. 12 is attached to driven shaft 163 in a manner similar to that depicted in the latter FIG.

What is claimed is:

1. A micro-torque and shock limiting subassembly for a production tool for providing a linear loading function with time with limited shock generation at a bit capable of operative connection to an fastener, comprising a hollow cylindrically shaped housing having a longitudinal axis of symmetry, and a side wall, and central cavity, all concentric of said axis of symmetry, a combination bit retainer-clutch mechanism supported within said central cavity of said housing and including a pair of cylindrical clutch disks of a plastic composite composed of teflon fluorocarbon and acetal resin having bulbous regions at a common diameter D1 in axially broad contact with each other to define a primary transverse braking surface therebetween of area $\pi(D1/2)^2$, reduced regions of diameter D2 each facing in an opposite direction to the other, and shoulder regions formed between said bulbous and reduced regions of said clutch disks, secondary braking washer means of annular cross section of a plastic composite composed of teflon fluorocarbon and acetal resin, positioned within said housing in broad contact with at least one of said shoulder regions of one of said pair of cylindrical clutch disks, to define a secondary braking surface parallel to said primary braking surface equal to $$\pi\left[\left(\frac{D1 - D2}{2}\right)\right]^2$$

where D1 and D2 are the exterior and interior diameters of said secondary braking washer means, means for providing a longitudinal force normal to said secondary and primary braking surfaces whereby a composite friction force is established thereat that can be related to a preset micro-torque value whereby a linear loading torque function without undue shock generation is provided.

2. The micro-torque and shock limiting subassembly of claim 1 in which one of said reduced regions of diameter D2 of said combination bit retainer-clutch mechanism include a first reduced region extending through said secondary braking washer means and wherein said side wall includes an end wall including a central opening, said first reduced region also extending through said central opening wherein said end segment remote from said shoulder region includes a bit receiving surface exterior of said housing.

3. The micro-torque and shock limiting subassembly of claim 2 in which said reduced regions of diameter D2 of said combination bit retainer-clutch mechanism include a second reduced region extending opposite to said first reduced region, a washer of annular cross section slidably fitting about said second reduced region in contact with said shoulder defined thereby and wherein said second reduced region includes an end segment having a transverse opening thereon normal to said axis of symmetry, and a drill stem attached to said transverse opening and extending longitudinally therefrom exterior of said housing.

4. The micro-torque and shock limiting subassembly of claim 3 in which said housing includes an open end through said drill stem extends and wherein said means for providing a longitudinal force normal to said secondary and primary braking surfaces includes (i) a cap member of annular cross section threadably positioned within said cavity of said housing adjacent to said open end of said housing includes a central opening through which said drill stem extends and (ii) a compression spring having a first end coil region in operative contact about said washer as well as being concentrically positioned about said second reduced region and a second end coil region opposite to said first end coil region in contact with said cap member as well as being concentrically positioned about said drill stem.

5. The micro-torque and shock limiting subassembly of claim 4 wherein rotation of said cap member results in rectilinear travel thereof and incremental compressional force change of said compression spring whereby said primary and secondary braking surfaces can be provided said composite friction force so as to provide a linear loading function with time up to a preset micro-torque value, with limited shock generation thereafter being generated at a micro-torque value above said preset value.

6. The micro-torque and shock limiting subassembly of claim 5 with the addition of rotational means rotatably attached to said drill stem to form a micro-torque and shock limiting production tool wherein rotation of said drill stem results in common rotation of said bit receiving surface of said one reduced region exterior of said housing.

7. The micro-torque and shock limiting subassembly of claim 6 in which rotational means is a conventional drill having a chuck attached to said drill stem wherein rotation of said drill stem results in common rotation of said bit receiving surface of said one reduced region exterior of said housing.

8. The micro-torque and shock limiting subassembly of claim 1 with the addition of an annularly shaped retaining member threadably positioned to said side wall of said housing in broad contact with said shoulder region of said second reduced region, in which one of said reduced regions of diameter D2 of said combination bit retainer-clutch mechanism include a first reduced region extending through said secondary braking washer means and through said retaining member, wherein said end segment remote from said shoulder region includes a drill stem receiving surface and a drill stem attached to said receiving surface and extending therefrom.

9. The micro-torque and shock limiting subassembly of claim 8 in which said reduced regions of diameter D2 of said combination bit retainer-clutch mechanism include a second reduced region extending opposite to said first reduced region, a washer of annular cross section slidably fitting about said second reduced region in contact with said shoulder defined thereby and wherein said second reduced region includes an end segment having a transverse opening thereon normal to said axis of symmetry, and a bit holding means attached to said transverse opening and extending longitudinally therefrom exterior of said housing.

10. The micro-torque and shock limiting subassembly of claim 9 wherein said means for providing a longitudinal force normal to said secondary and primary braking surfaces includes (i) a cap member of annular cross section threadably positioned relative to said housing and including a central opening through which said bit holding means extends and (ii) a compression spring having a first end coil region in operative contact about said washer as well as being concentrically positioned about said second reduced region and a second end coil region opposite to said first end coil region in contact with said cap member as well as being concentrically positioned about bit holding means.

11. The micro-torque and shock limiting subassembly of claim 10 wherein rotation of said cap member results in rectilinear travel thereof and incremental compressional force change of said compression spring whereby said primary and secondary braking surfaces can be provided said composite friction force so as to provide a linear loading function with time up to a preset micro-torque value, with limited shock generation thereafter being generated at a micro-torque value above said preset value.

12. The micro-torque and shock limiting subassembly of claim 11 with the addition of rotational means rotatably attached to said drill stem to form a micro-torque and shock limiting production tool wherein rotation of said drill stem results in common rotation of said bit receiving surface of said one reduced region exterior of said housing.

13. The micro-torque and shock limiting subassembly of claim 12 in which rotational means is a conventional drill having a chuck attached to said drill stem wherein rotational of said drill stem results in common rotation of said bit receiving surface of said one reduced region exterior of said housing.

14. The micro-torque and shock limiting subassembly of claim 12 in which rotational means is an electrically powered motor means having a drive shaft attached to said drill stem wherein rotation of said drill stem results in common rotation of said bit receiving surface of said one reduced region exterior of said housing but wherein said motor means is completely supported within said housing.

15. In providing a linear loading function with time with limited shock generation, the combination comprising a bit capable of operative connection to a fastener, a micro-torque and shock limiting subassembly operative connected to said bit providing a linear loading function up to said preset torque value, comprising a hollow cylindrically shaped housing having a longitudinal axis of symmetry, and a side wall, and central cavity, all concentric of said axis of symmetry, a combination bit retainer-clutch mechanism supported within said central cavity of said housing and including a pair of cylindrical clutch disks of a plastic composite composed of teflon fluorocarbon and acetal resin having bulbous regions of a common diameter D1 in axially broad contact with each other to define a primary transverse braking surface therebetween of area $\pi(D1/2)^2$, reduced regions of diameter D2 each facing in an opposite direction to the other, and shoulder regions formed between said bulbous and reduced regions of said clutch disks, secondary braking washer means of annular cross section of a plastic composite composed of teflon fluorocarbon and acetal resin, positioned within said housing in broad contact with at least one of said shoulder regions of one of said pair of cylindrical clutch disks, to define a secondary braking surface parallel to said primary braking surface equal to $$\pi\left[\left(\frac{D1-D2}{2}\right)\right]^2$$

where D1 and D2 are the exterior and interior diameters of said secondary braking washer means, means for providing a longitudinal force normal to said secondary and primary braking surfaces whereby a composite friction force is established thereat that can be related to a preset micro-torque value whereby a linear loading torque function without undue shock generation is provided.

16. The combination of claim 15 in which one of said reduced regions of diameter D2 of said combination bit retainer-clutch mechanism include a first reduced region extending through said secondary braking washer means and wherein said side wall includes an end wall including a central opening, said first reduced region also extending through said central opening wherein said end segment remote from said shoulder region includes a bit receiving surface exterior of said housing.

17. The combination of claim 16 in which said reduced regions of diameter D2 of said combination bit retainer-clutch mechanism include a second reduced region extending opposite to said first reduced region, a washer of annular cross section slidably fitting about said second reduced region in contact with said shoulder defined thereby and wherein said second reduced region includes an end segment having a transverse opening thereon normal to said axis of symmetry, and a drill stem attached to said transverse opening and extending longitudinally therefrom exterior of said housing.

18. The combination of claim 17 in which said housing includes an open end through said drill stem extends and wherein said means for providing a longitudinal force normal to said secondary and primary braking surfaces includes (i) a cap member of annular cross section threadably positioned within said cavity of said housing adjacent to said open end of said housing including a central opening through which said drill stem extends and (ii) a compression spring having a first end coil region in operative contact about said washer as well as being concentrically positioned about said second reduced region and a second end coil region opposite to said first end coil region in contact with said cap member as well as being concentrically positioned about said drill stem.

19. The combination of claim 18 with the addition of rotational means rotatably attached to said drill stem to form a micro-torque and shock limiting production tool wherein rotation of said drill stem results in common rotation of said bit receiving surface of said one reduced region exterior of said housing.

20. The combination of claim 19 in which rotational means is a conventional drill having a chuck attached to said drill stem wherein rotation of said drill stem results in common rotation of said bit receiving surface of said one reduced region exterior of said housing.

21. The combination of claim 15 with the addition of an annularly shaped retaining member threadably positioned to said side wall of said housing in broad contact with said shoulder region of said second reduced region, in which one of said reduced regions of diameter D2 of said combination bit retainer-clutch mechanism include a first reduced region extending through said secondary braking washer means and through said retaining member, wherein said end segment remote from said shoulder region includes drill stem receiving surface and a drill stem attached to said receiving surface and extending therefrom.

22. The combination of claim 15 in which said plastic composite composed of teflon fluorocarbon and acetal resin has a coefficient of friction in a range of 0.08 to 0.20.

* * * * *